US006330946B1

(12) United States Patent
Allen

(10) Patent No.: US 6,330,946 B1
(45) Date of Patent: Dec. 18, 2001

(54) APPARATUS AND METHOD FOR SEPARATING PARTICLES

(75) Inventor: Neil Robert Allen, Tasmania (AU)

(73) Assignee: KA PTY Ltd., Tasmania (AU)

( * ) Notice: Subject to any disclaimer, the term of this patent is extended or adjusted under 35 U.S.C. 154(b) by 0 days.

(21) Appl. No.: 09/242,102

(22) PCT Filed: Aug. 6, 1997

(86) PCT No.: PCT/AU97/00496

§ 371 Date: Feb. 8, 1999

§ 102(e) Date: Feb. 8, 1999

(87) PCT Pub. No.: WO98/06500

PCT Pub. Date: Feb. 19, 1998

(30) Foreign Application Priority Data

Aug. 8, 1996 (AU) ..... PO 1495

(51) Int. Cl.[7] ..... B03C 1/247

(52) U.S. Cl. ..... 209/219; 209/225; 209/228; 209/231; 209/232

(58) Field of Search ..... 209/212, 213, 209/214, 215, 216, 217, 218, 219, 220, 225, 226, 227, 228, 229, 230, 231, 232

(56) References Cited

U.S. PATENT DOCUMENTS

| | | | | |
|---|---|---|---|---|
| 1,417,189 | | 5/1922 | McCarthy | 209/212 |
| 4,834,870 | | 5/1989 | Osterberg et al. . | |
| 4,869,811 | | 9/1989 | Wolanski et al. . | |
| 5,064,075 | * | 11/1991 | Reid | 209/212 |
| 5,080,234 | | 1/1992 | Benson . | |
| 5,108,587 | * | 4/1992 | Walker | 209/212 |

FOREIGN PATENT DOCUMENTS

| | | |
|---|---|---|
| 254030 | 7/1926 | (GB) . |
| 751415 | 6/1956 | (GB) . |
| 9309873 | 5/1993 | (WO) . |

* cited by examiner

*Primary Examiner*—John M. Jillions
(74) *Attorney, Agent, or Firm*—Birch, Stewart, Kolasch & Birch, LLP

(57) ABSTRACT

Apparatus for separating particles such as minerals from a mixture including said particles. The apparatus includes means for generating a rotating magnetic field such as a rotating magnetic drum (71). The apparatus also includes means for exposing the mixture to the rotating magnetic field such that susceptible particles are caused to rotate, and means for exploiting the rotation imparted to the susceptible particles to separate the particles from the mixture. The means for exposing may include a conveyor belt (72) or the like for passing the mixture along a first path (70) relative to the rotating magnetic field. The means for exploiting may include a surface (74) for facilitating movement of the particles along a second path (A) other than the first path.

38 Claims, 8 Drawing Sheets

APPARATUS AND METHOD FOR SEPARATING PARTICLES

This application is the national phase under 35 U.S.C. §371 of prior PCT International Application No. PCT/AU97/00496 which has an International filing date of Aug. 6, 1997 which designated the United States of America.

The present invention relates to apparatus and a method for separating particles such as minerals. More specifically the invention relates to apparatus and a method which utilises a rotating magnetic field for effecting separation of particles by rotation of individual particles in the rotating magnetic field.

Separators which utilize a magnetic field which rotates are known, but in prior art separators particle separation is primarily effected by magnetic attraction of magnetised particles in a magnetic field gradient, and is not significantly effected by particle rotation in a rotating magnetic field.

Prior art wet drum magnetic separators utilise rotations of a magnetic field to release entrapped non-magnetic and other adhering particles from magnetic flocs. In these prior art separators particle separation is not effected by particle rotation, and particles experience only a small number of rotations (between 2 and 4 complete rotations) before passing out of the separator.

Induced-roll types of magnetic separators are sometimes referred to as employing a rotating magnetic field. In these prior art separators, the field may rotate with the drum, but around any particular circumference the field is always in the same direction relative to the drum surface, and particle rotation plays no part in the actual separation process. Some separators which balance centrifugal forces against buoyancy in a magnetically controlled heavy liquid have also been referred to as employing a rotating magnetic field, but this field is not designed to produce particle rotations, and particle separation is not effected by particle rotations.

Modern eddy-current separators do use a rotating magnetic drum and a particle above the drum surface does experience a field which rotates. This rotation may cause non-ferrous metallic particles to rotate, and such particle rotation has been documented. However such particle rotations have previously been regarded as an undesirable side effect and a limiting factor which detracts from separator performance rather than as a means of aiding or accomplishing the separation. The rotations have been documented in order to determine ways to minimise them (eg. by flattening or squashing smaller particles). Modern eddy-current separators are designed to emphasise a magnetic field which rapidly changes direction radial to their magnetic drums rather than a magnetic field which rotates at a constant angular velocity. Particle rotation is not used as the means of accomplishing the separation.

The separator of the present invention utilizes a magnetic field such that the field direction or vector rotates. Mineral particles that are caused to rotate by rotation of the magnetic field are those particles that are separated. The rolling or spinning motion that is induced in particles by rotation of the magnetic field is used to influence those particles to move along a different path to that taken by particles that do not rotate as a result of the magnetic field rotations. In at least some embodiments of the present invention movement and magnetic separation of particles may be assisted by non-rotating magnetic or gravitational forces. In some embodiments of the invention movement and magnetic separation of the particles may be assisted by centrifugal forces. The particles to be separated may be delivered to the separator in any convenient fluid and by any convenient means. The rottating magnetic field may be generated by either mechanical or electrical means.

A convenient way of generating the effect of a rotating magnetic field is to use alternate magnetic poles spaced around the circumference of a rotating drum, as illustrated in FIGS. 2, 4, 5 and 7. This arrangement is similar to that employed in some present eddy current separators. The physical mechanism by which rotary motion is induced in a particle may be explained with reference to FIG. 1. A metal particle 10 supported on a stationary surface 11 is exposed to a rotating magnetic field set up via magnetic drum 12. Magnetic drum 12 includes magnetic poles 13 which rotate in the direction shown via arrow A. Particle 10 experiences a moving magnetic field 14 which from the frame of reference of particle 10 rotates within a plane in the direction shown via arrow B. If particle 10 is metallic, the rotating magnetic field generates eddy currents in particle 10 which react with the rotating field to produce a rotating torque. If particle 10 is magnetic and non-metallic, the rotating magnetic field interacts with particle 10 to produce a rotating torque. Particle 10 experiences a torque in the direction in which the magnetic field rotates. This torque in combination with friction between particle 10 and surface 11 causes the particle to roll to the left along surface 11 in FIG. 1.

For this separator to operate, particles must be sufficiently held to a surface in order for any particle rotation to cause it to roll. This is accomplished by using either gravity (as in FIGS. 6, 8 and 9), particle attraction in a field gradient (the dominant force in FIGS. 2 and 3), centrifugal force, or a combination of these forces. The arrangement shown in FIGS. 6 and 7, when used on weakly ferrimagnetic minerals, employs attraction in a field gradient as a means of reducing but not quite overcoming, the force of gravity. This allows weakly rotating particles to be rotated but still retain sufficient interaction with a surface so that their spinning will cause them to roll to one side.

The separator of the present invention is adapted to separate minerals on the basis of the magnetic and/or conductive properties of those minerals. These properties include magnetic susceptibility, the degree and type of magnetic ordering within the particles, the crystal structure of the particles, and the conductivity of the particles. Separation of particles may be controlled by several factors including some or all of the following: magnetic field strength of the rotating field; gradient of the magnetic field and its direction; variation of field strength as the magnetic field rotates; and frequency of rotation of the magnetic field.

Movement of mineral particles may be predominantly due to spin or rolling induced in the particles by the rotating magnetic field. The rotating field may be generated by mechanical and/or electronic means. Mechanical field generators may include permanent magnets and rotating elements such as drums, cylinders and the like. The latter may be rotatably driven via motive means such as electric motors or chemical engines or other sources of rotational power.

Electronic field generators may include a plurality of static windings adapted to be energized by alternating electric currents so as to generate a rotating magnetic field not unlike that in a stator of a rotating electric machine. In at least some embodiments of the present invention movement of the particles may be assisted by non-rotating or bulk magnetic forces exerted on particles to be separated.

The separator of the present invention can make particles spin continuously and individually, and this can have advantages over prior art methods for separating ferromagnetic and ferrimagnetic minerals. Individual spinning of particles may break up or prevent formation of magnetic flocs, and may prevent entrapment of non-magnetic particles and interaction between paramagnetic and ferromagnetic or ferrimagnetic minerals.

Separation of conductive particles may take place either in the dry or in a slurry. This is in contrast to prior art conductive minerals separation which requires drying of minerals before separation. No close screening may be required for input material to be separated.

The separator of the present invention may make use of crystallography of particles or degree of magnetic ordering within particles to discriminate between particles which have the same or similar magnetic susceptibilities but different amounts of magnetic anisotropy or have different degrees or types of magnetic ordering.

The rotation of the magnetic particles is due to the presence of magnetic anisotropy or magnetic ordering within the particles, which attempts to confine particle magnetisation to particular directions within the particles. The induced particle rotation may be in the same sense as the magnetic field rotation, or they may be another direction (eg. particle spin axis at right angles to the field rotation axis) due to such effects as precession of electron spins as the external field attempts to rotate them.

It will be convenient to define a "rotation index" for a particle. The term rotation index may be defined in terms of the ratio R, where:

$$R = \frac{\text{Torque required to physically roll a particle against gravity}}{\text{Particle magnetisation} \times \text{magnetic field}}$$

If the magnetic susceptibility or the magnetic moment of a particle is known, and the field strength and gradient at which it begins to rotate are known, then the ratio R can be readily calculated.

The magnetic drum used in the present invention, and exemplified in FIG. 1, may be used to obtain good estimates of "magnetic susceptibility" and "rotation" index of a mineral particle. FIG. 10 shows a mineral separator which has been modified for measuring magnetic susceptibility and rotation index of particles. In this case mineral separation cells associated with the separator have been removed and replaced by a particle measurement means. Rotating magnetic drum 90 is similar to the drum noted above with reference to FIGS. 2, 4 and 6. A mineral particle 91 being measured is sealed in a small thin-walled fluid filled (usually water) glass tube 92. Glass tube 92 is held horizontally under magnetic drum 90, as shown, by holding means 93. Holding means 93 includes means to move glass tube 92 up and down, and is calibrated so that the distance (x) from magnetic drum 90 may be measured. Glass tube 92 is raised towards the magnetic drum 90 until particle 91 commences to rotate and to roll down the glass tube. The value of x then gives the magnetic field and field gradient at which this occurs. Glass tube 92 is then raised further towards the surface of magnetic drum 90 until particle 91 is lifted in the magnetic field gradient. The value of x again gives the magnetic field and field gradient. The field strengths measured in this way may then be used to calculate the magnetic susceptibility ($K_g$) for paramagnetic particles, the magnetic moment ($M_m$) for saturated ferromagnetic or ferrimagnetic particles, and the two rotation indices $R_f$ (ferromagnetic rotation index) and $R_p$ (paramagnetic rotation index), using the equations below:

$$K_g = \frac{\mu_o a\left(1 - \frac{D_f}{D_p}\right)}{B_l \frac{\delta B_l}{\delta x}} \tag{1}$$

$$M_m = \frac{\mu_o a}{\frac{\delta B_l}{\delta x}} \tag{2}$$

Where: $B_1$ is the magnetic field (T) at which the particle is lifted a is the acceleration due to gravity ($m.sec^{-1}$)

$$\frac{\delta B_l}{\delta x}$$

is the magnetic field gradient ($T.m^{-1}$) at which the particle is lifted $D_f$ is the density of the immersion fluid ($kg.m^{-3}$)

$D_p$ is the density of the particle ($kg.m^{-3}$)

$$R_p = \frac{d\left(\frac{\mu_0 a}{4\pi \times 10^{-3}}\left(1 - \frac{D_f}{D_p}\right) - K_g B_r \frac{\delta B_r}{\delta x}\right)}{2K_g B_r^2} \tag{3}$$

$$R_f = \frac{d\left(\mu_0 a\left(1 - \frac{D_f}{D_p}\right) - M_m \frac{\delta B_r}{\delta x}\right)}{2M_m B_r} \tag{4}$$

Where: d is the particle diameter (m)

$K_g$ is the magnetic susceptibility (cgs)

$B_r$ is the magnetic field where particle rotation commences (T)

$$\frac{\delta B_r}{\delta x}$$

is the field gradient where particle rotation commences ($T.m^{-1}$)

$M_m$ is the magnetic moment measured at the point of particle lift

Magnetic drums of similar construction to those used in the present invention have a magnetic field (B) and field gradient $$\frac{\delta B}{\delta x}$$

radially outwards from the drum surface which may be readily, and accurately, described by the expressions:

$$B = \frac{C}{b^{(x \times 1000)}} \quad \text{and} \quad \frac{\delta B}{\delta x} = \frac{C \ln(x) \times 10^3}{b^{(x \times 1000)}}$$

Where: C is the maximum field at the drum surface (T)

b is a calibration constant for the particular drum (determined by experiment)

x is the distance radially away from the drum surface (m)

The magnetic drums may therefore be readily calibrated, and a simple measurement of the distance from the drum surface (x) allows the field and field gradient to be calculated.

While equations (1) to (4) make use of measurements which can be made with a rotating drum as shown in FIG. 9, the measurements can equally be made by other methods.

It should be noted that the values of $K_g$, $R_p$ and $R_f$ may vary with rotation frequency of the magnetic field. These values, and how they vary with field rotation frequency can give useful information on the nature of magnetic ordering and magnetic anisotropy within a particle. This information may be used to design a magnetic separation technique for a particular application. It may also be used to infer the conditions of temperature or pressure under which a mineral is formed.

For example, if the particle does not rotate at all, for any magnetic field strength and rotation frequency, then it is paramagnetic and follows the Curie law.

If the particle only rotates, in the same sense as the field rotations, at the point of lift or very close to it ($R_p$ would be zero for rotation at the point of lift, and close to zero otherwise), the particle is most probably paramagnetic and follows the Curie-Weiss law.

If $R_f$ is greater than 1 then the particle is rotating very much better than would be indicated, for a saturated ferromagnetic particle, by the measured magnetic moment. The particle then has to be ferrimagnetic. Normally a ferrimagnetic ordering would be indicated by $R_f$ greater than 0.71. Particles with $R_f$ less than 0.71 may be ferromagnetic or ferrimagnetic, but most mineral particles are ferrimagnetic.

The relationship between the rotation index (usually $R_f$) and the magnetic susceptibility may be of some importance. For example, a high magnetic susceptibility but a low rotation index may be indicating a cation-disordered state in the particle which would suggest mineral formation at high temperatures.

The terms "ferromagnetic rotation index" and "paramagnetic rotational index" refer to quantities which have been coined by the present inventor.

In some embodiments, the separator of the present invention, is able to generate rotations in paramagnetic particles which may be due to a transfer to the particles of angular momentum from electron precessions. Such rotations are at right angles to the magnetic field rotations and their strength depends on the degree to which electron precessional momentum is transferred to the particle structure. These rotations may be used to discriminate between paramagnetic minerals which have the same magnetic susceptibilities but different crystallography.

The observation of precessional rotation in paramagnetic particles has not to applicant's knowledge been recorded anywhere in the literature, although a precessional rotation effect is well documented for ferromagnetic substances.

The effect arises from the precession or attempted precessions of electron orbital motion and electron spins as they are forced to rotate with a rotating external field. The torque which could be placed on a particle as a result of electron spin precession is given by:

$$\tau = \frac{2\pi f K_g m_p m_e H}{e}$$

Where: f is the rotation frequency of the external field $K_g$ is the magnetic susceptibility $M_P$ is the mass of the particle $m_e$ is the mass of the electron H is the magnetic field strength e is the electron charge Normally such a torque could only cause a particle to "wobble" around at the field rotation frequency, but if the magnetic field is arranged so that its strength is always stronger in one particular orientation than any other (ie. the field strength varies throughout a field rotation), the torque will be predominantly in the one direction, and this direction will have its rotation axis at right angles to the axis of the external field rotation.

A magnetic drum similar to that shown in FIG. 7, but with one set of magnetic poles (say the N poles) either longer than or stronger than the others, may be used to produce a suitable rotating field so as to enhance these "right-angle" particle rotations. An alternative method may be to use a magnetic drum as shown in FIG. 7, but to add a constant direction biasing field (eg. from a separate electromagnet).

Particles may also be caused to rotate at right angles to the magnetic field rotations if the particles become electrically charged and the strength of the rotating field is biased in a constant direction. A particle may become electrically charged as a result of chemical actions between the slurry fluid and a particle, or by any other means.

Conductive mineral separation according to the present invention is based on the principle that a conductor when placed in a changing magnetic field has eddy currents induced in it which oppose the change in the field. The conductor therefor experiences a repulsive force. More specifically a conductive particle when placed in a rotating magnetic field which is of relatively uniform strength, will experience a rotating force (torque) which acts to rotate the particle in the direction of rotation of the field. If gravity or another force (eg. centrifugal) holds the particle in contact with a surface the particle may be made to roll across the surface.

A ferromagnetic particle in a rotating field will align itself with the field and will attempt to remain aligned. Thus a ferromagnetic particle will rotate with the field and will also roll across a surface. A paramagnetic particle may also roll across a surface due to magnetic anisotropy.

A separator constructed according to the principles of the present invention may have the capacity to separate free gold down to substantially less than 10 microns particularly through the use of rotating fields generated either electronically or mechanically.

The separator may be tuned to separate ferromagnetic, degrees of paramagnetic and conductive minerals. Tuning may be achieved inter alia, by adjusting the strength/frequency of the rotating magnetic field. For ferromagnetic and paramagnetic separation the frequency of the field may be kept relatively low, say less than 500 Hz and preferably less than 100 Hz. For ferromagnetic separation field strength may be relatively low (generally around 1000 gauss) but this may be increased for paramagnetic separation according to the type of mineral being treated and permitted by the kind of magnets being employed (separating magnetic fields up to 5000 gauss may be conveniently obtained with present rare earth magnets). For separation of conductive- minerals, the frequency may be increased (say up to 1 khz utilizing mechanical means of field rotation) and field strengths which are as high as possible are preferably used.

The separator of the present invention may also be used to separate non-ferrous conductive particles through generation of eddy currents within the particle. Instead of relying on the generation of a bulk repulsive force, as is done in present eddy current separators which are unable to separate very small metallic particles, use of a rotating magnetic field produces eddy currents which cause the particles to rotate.

Eddy current separation of small non-ferrous metallic particles may be described approximately by the equation:

$$\tau = \frac{\pi^2 B^2 d^5 f}{5\rho} \quad (6)$$

Where: π is the torque placed on the particle

B is the magnetic field strength d is the particle diameter f is the field rotation frequency ρ is the resistivity of the metal The minimum cubic-shaped non-ferrous metallic particle size which may be separated by any combination of magnetic field strength and field rotation frequency may be derived from the above equation and is:

$$d = c \times \frac{\rho D}{B^2 f} \quad (7)$$

Where: D is the particle density and $$C = \frac{5g}{\pi^2}$$

(g is the acceleration due to gravity)

According to one aspect of the present invention there is provided a method for separating particles such as minerals from a mixture including said particles, said method including the steps of: generating a rotating magnetic field; exposing said mixture to said rotating magnetic field so that a plurality of susceptible particles may be caused to rotate; adjusting said rotating magnetic field to cause a rotation of a subgroup of said susceptible particles; and exploiting the rotation of said subgroup of susceptible particles to separate the subgroup of particles at least from other susceptible particles included in the mixture that do not rotate.

According to a further aspect of the present invention there is provided. an apparatus for separating particles such as minerals from a mixture including said particles, said apparatus including: means for generating a rotating magnetic field; means for exposing said mixture to said rotating field. such that susceptible particles may be caused to rotate; means for adjusting said rotating magnetic field to cause a subgroup of said susceptible particles to rotate; and means for exploiting the rotation of said subgroup of susceptible particles to separate the subgroup of particles at least from other potentially susceptible particles included in the mixture that do not rotate.

According to one aspect of the present invention there is provided a method for separating particles such as minerals from a mixture including said particles, said method including the steps of:

generating a rotating magnetic field;

exposing said mixture to said rotating field so that susceptible particles are caused to rotate; and exploiting the rotation imparted to the susceptible particles to separate the particles from the mixture.

According to a further aspect of the present invention there is provided apparatus for separating particles such as minerals from a mixture including said particles, said apparatus including:

means for generating a rotating magnetic field;

means for exposing said mixture to said rotating field such that susceptible particles are caused to rotate; and means for exploiting the rotation imparted to the susceptible particles to separate the particles from the mixture.

According to a still further aspect of the present invention there is provided apparatus for measuring magnetic susceptibility and/or rotation index of a particle including:

means for generating a rotating magnetic field;

means for exposing said particle to said rotating field; and means for moving said exposing means a calibrated distance from the means for generating.

Preferred embodiments of the present invention will now be described with reference to the accompanying drawings. The drawings are to be taken as examples only and do not restrict the invention to the forms illustrated.

Figure 1:
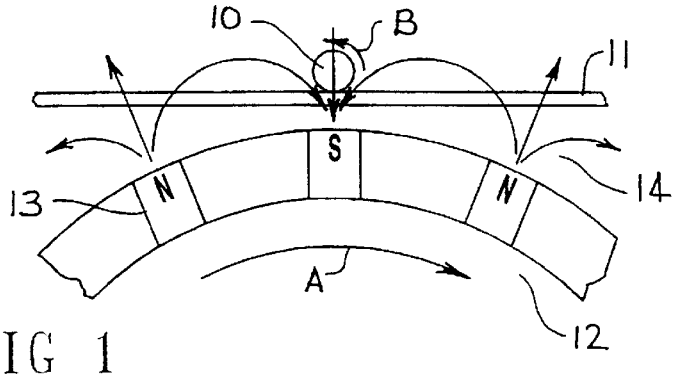
FIG. 1 shows the principles involved in generating a rotating magnetic field.
Figure 3:
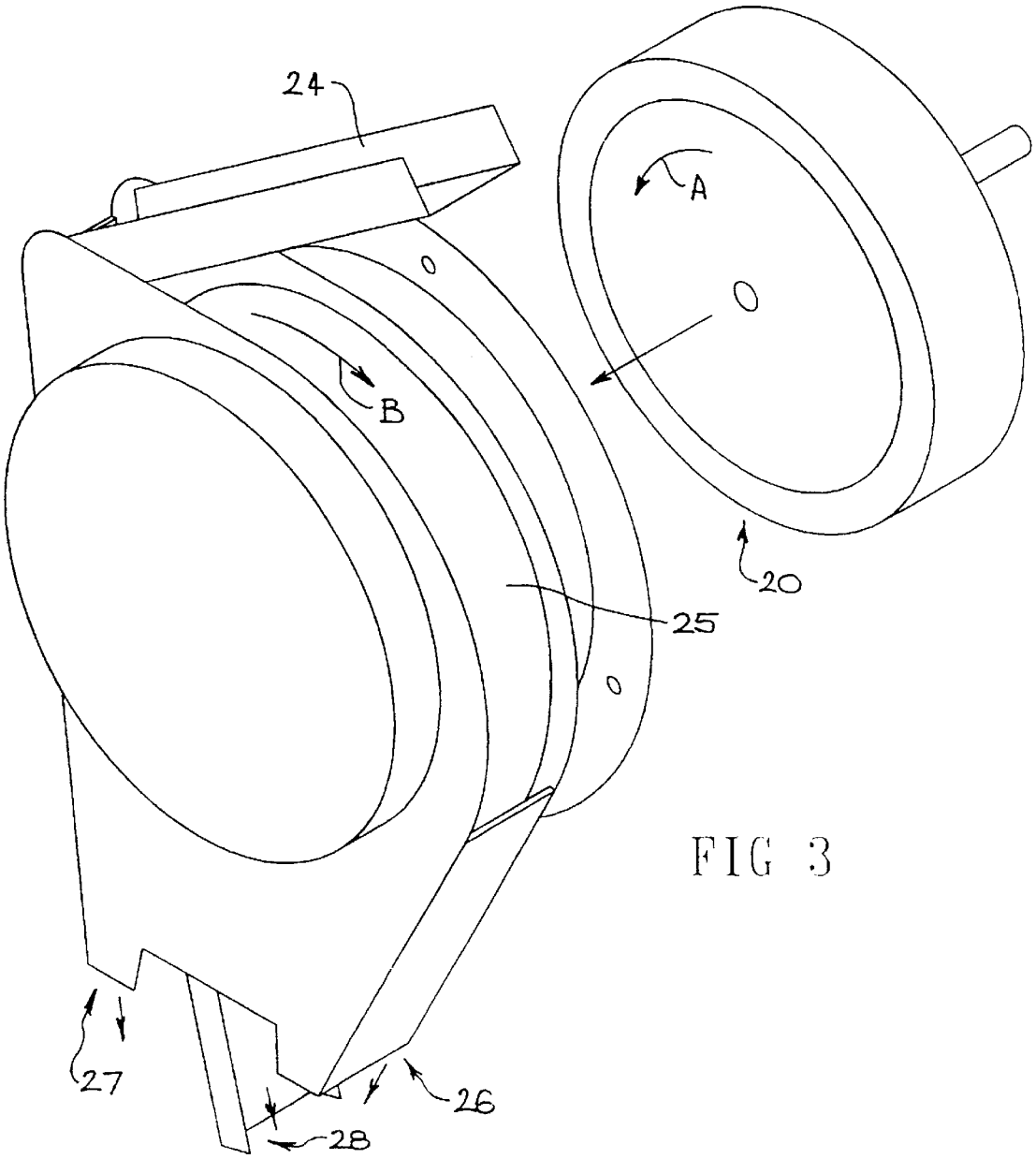
FIGS. 2 and 3 show front and exploded perspective views respectively of one form of separator suitable for dry separation of small ferromagnetic particles (eg. iron particles from grinding operations) from fine powders.
Figure 2:
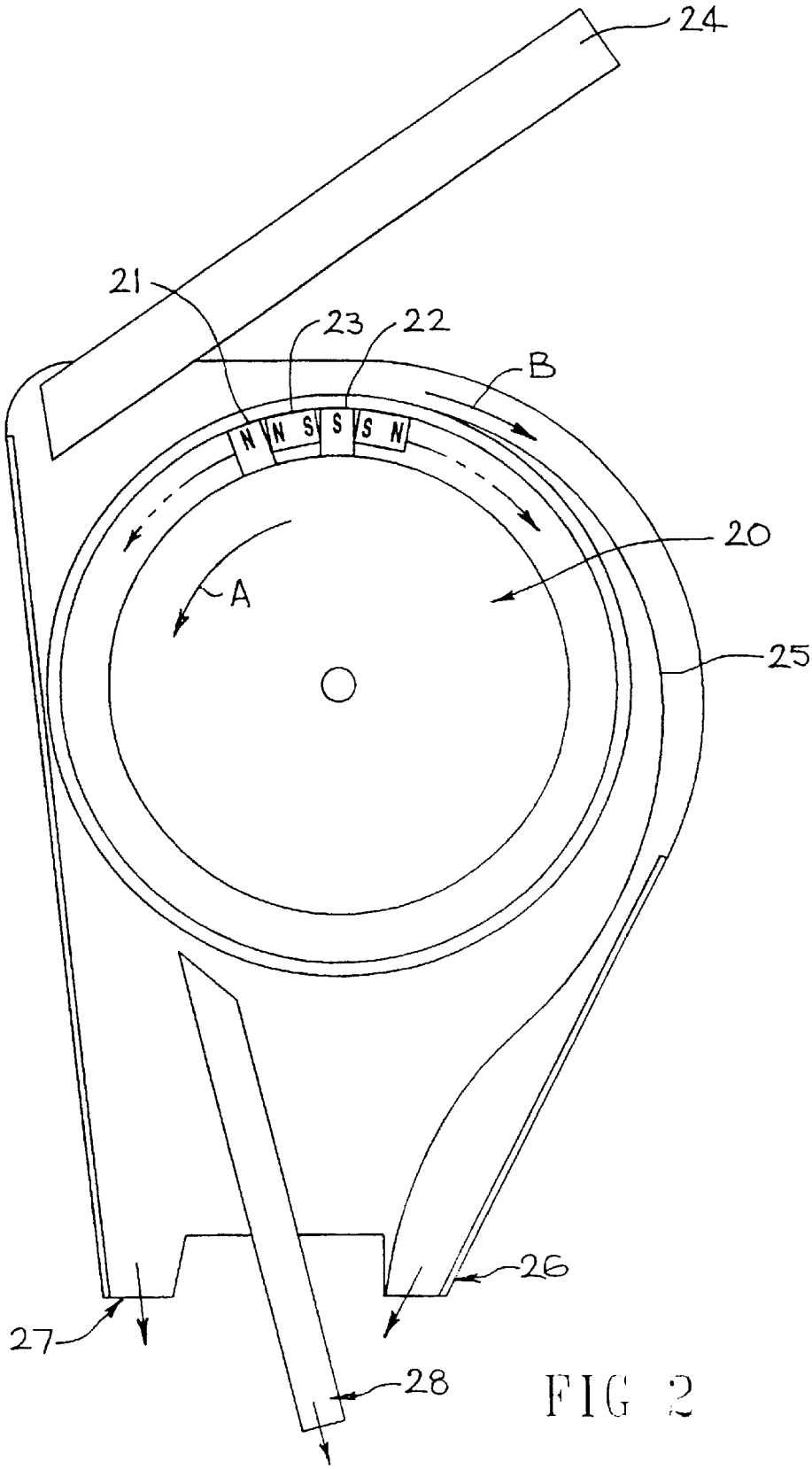

Referring to FIGS. 2 and 3, a basic separator utilising michanical field rotation is shown. The separator comprises a magnetic drum 20 which rotates around a central axis. Attached to the outer circumference of magnetic drum 20 are alternating north and south magnetic poles provided by radial magnets 21, 22 (refer FIG. 2). Tangential or bucking magnets 23 are also fitted between radial magnets 21, 22. The purpose of the latter is to increase the tangential field strength between radial magnets 21, 22 and to prevent magnetic flux leakage from the sides of radial magnets 21, 22. Magnetic drum 20 rotates around its axis inside the separator in the direction shown by arrow A. As magnetic drum 20 rotates, ferromagnetic or ferrimagnetic particles on the surface of the separator around the outside of magnetic drum 20 experience a magnetic field which is rotating. The magnetic field gradient around the outside of magnetic drum 20 is directed towards the centre of magnetic drum 20, and is able to attract magnetic particles to the surface of the separator and hold them against the surface as they rotate.

Material to be separated is fed down feed chute 24. As the material falls down inside the separator, ferromagnetic or strong ferrimagnetic particles experience both attraction towards the surface of drum 20 and rotation. These particles are attracted onto curved surface 25 of the separator which extends around the outside of magnetic drum 20 and are rolled up and over the top of drum 20 as shown by arrow B. As the particles roll over the top of drum 20, curved surface 25 is arranged so that the particles move further away from magnetic drum 20 and experience decreasing attraction towards magnetic drum 20. By the time the particles have descended the opposite side of the separator they are far enough away from drum 20 to escape under influence of gravity and fall out of outlet 26. Non-magnetic material falls straight through the separator and out of non-magnetic outlet 27. Weaker ferrimagnetic material is diverted by the magnetic field as it falls through the separator and exits via outlet 28 for weaker ferrimagnetics. Drum 20 (other than magnets 21, 22, 23), feed chute 24, curved surface 25 and outlets 26, 27 and 28 may be constructed from plastics or other non-metallic materials.

One advantage of this separator for separation of very magnetic material from fine powders is that particles are individually spinning in the rotating field. This spinning motion actively and energetically expels any adhering non-magnetic material and enables a more complete separation and a cleaner separated product. The frequency of magnetic field rotation may be as high as 200 to 500 Hertz, but frequencies of 10 to 100 Hertz are usually sufficient. In some applications it may be desirable for the frequency of the rotating magnetic field to be greater than 200 Hz.

Figure 4:
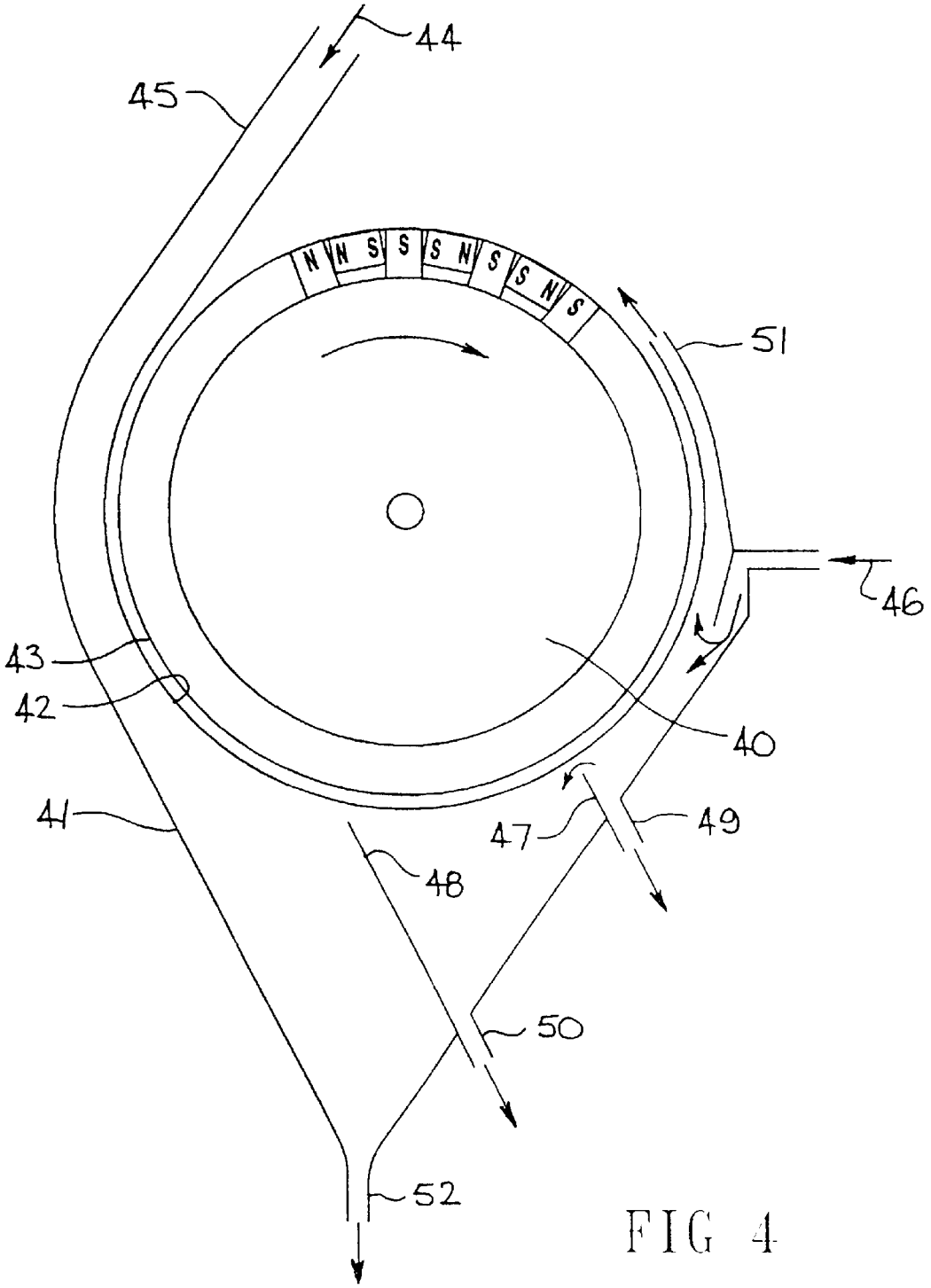
FIG. 4 shows one form of separator suitable for wet separation of ferromagnetic or ferrimagnetic minerals from a slurry.

The arrangement shown in FIG. 4 uses a rotating magnetic drum 40 similar to drum 20 in FIGS. 2 and 3. A separation bin or launder 41 is fitted underneath magnetic drum 40 so that upper internal surface 42 of launder 41 is concentric with outer surface 43 of magnetic drum 40. Slurry 44 is fed to inlet 45 of launder 41 as shown in FIG. 4. Control water is also fed to launder 41 through inlet 46. Means for controlling water flow (not shown) may be used to control the direction of water flow past the tops of internal splitters 47, 48 and controls the magnetic properties of products which are diverted to respective magnetic outlets 49, 50. As slurry 44 passes down through launder 41 magnetic particles are attracted towards magnetic drum 40. If the particles are ferromagnetic or strongly ferrimagnetic (eg. iron particles or magnetite) they will roll themselves around under magnetic drum 40 and up the other side, to exit via magnetic outlet 51. Ferrimagnetic material which is not held against the upper surface of launder 41 strongly enough or which does not rotate strongly enough to climb the right hand side of launder 41 (eg. most ilmenite and some pyrrhotite), is dislodged by water turbulence around control water inlet 46 and exits via magnetic outlet 49. Strong paramagnetic and weaker ferrimagnetic material (eg. some ilmenite and almandine garnet) are held strongly enough to the upper surface of launder 41 so that they follow the upper surface of launder 41 until they reach the lowest point under magnetic drum 40 where they fall off or are removed by water turbulence past the tops of splifters 47, 48. These particles exit via magnetic outlet 50. Non-magnetic particles pass through the separator and exit via the non-magnetic outlet 52. The means for controlling water flow may, by means of hydrodynamic pressure, dislodge weaker magnetic particles earlier or later. For example pressure may be reduced to allow separation of almandine garnet via magnetic outlet 50. Alternatively the pressure may be increased and almandine garnet will pass out via non-magnetic outlet 52. Magnetic field rotation frequencies can be used for limited tuning of the separations because some weaker ferrimagnetic particles, when rotating in water, are unable to continue rotating if the field rotation frequency becomes too high. Drum 40 (other than magnets associated therewith), launder 41, upper surface 42, inlets 45 and 46, splitters 47 and 48 and outlets 49, 50, 51 and 52 may be constructed from plastics or other non-metallic material.

Figure 5:
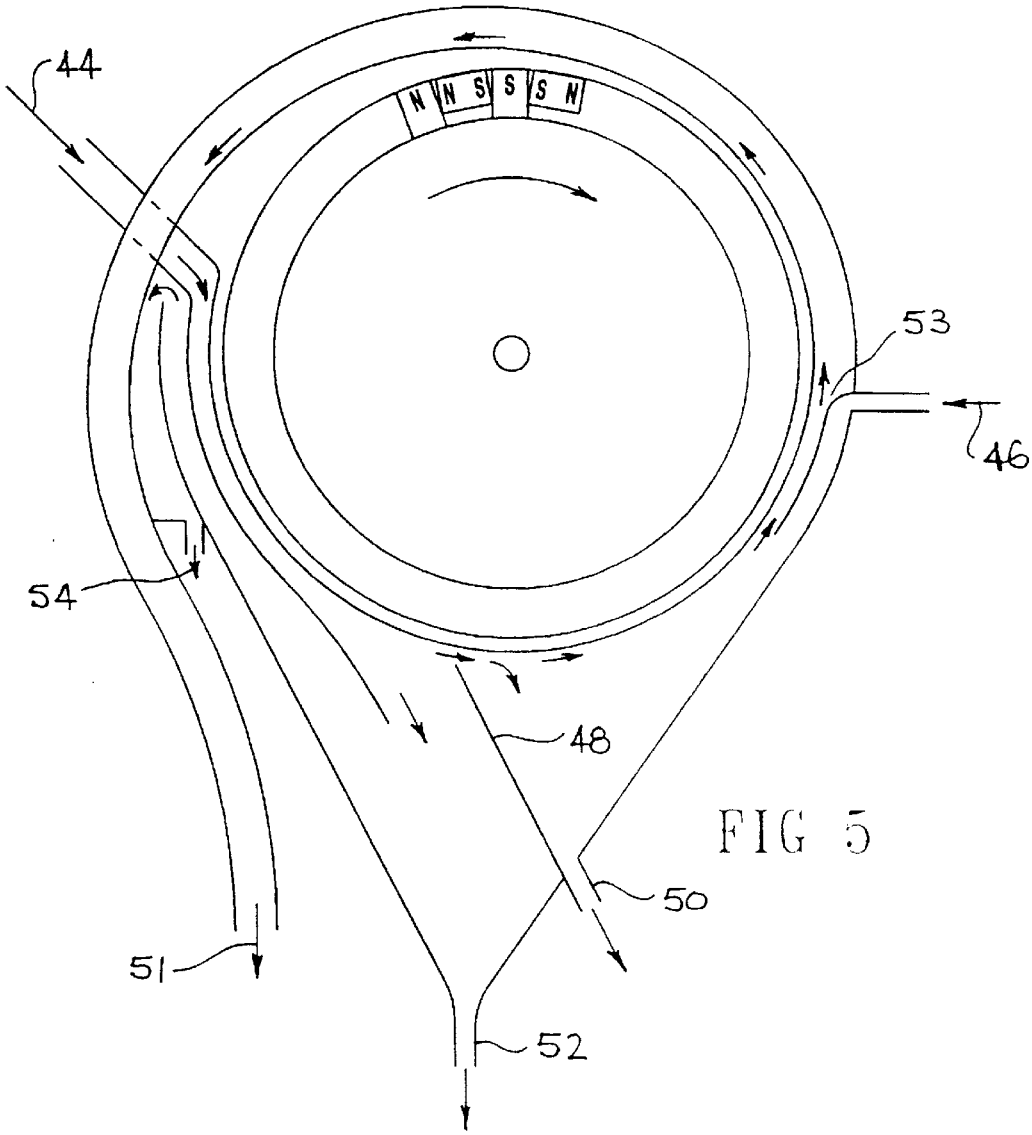
FIG. 5 shows a modification of the separator shown in FIG. 4.

During operation, the arrangement shown in FIG. 4 is essentially filled with water up to outlet 51. However, the arrangement may be modified as shown in FIG. 5 so that the water level within the separator is maintained at a level just above inlet 46. Outlet 51 will then be essentially dry and rotating particles will have to break through the water air interface 53 just above inlet 46 to roll themselves up the right hand side of the separator and over the top of the drum. The separator of FIG. 5 may allow a dryer product for the most magnetic material and is particularly suitable for separating magnetite.

Figure 6:
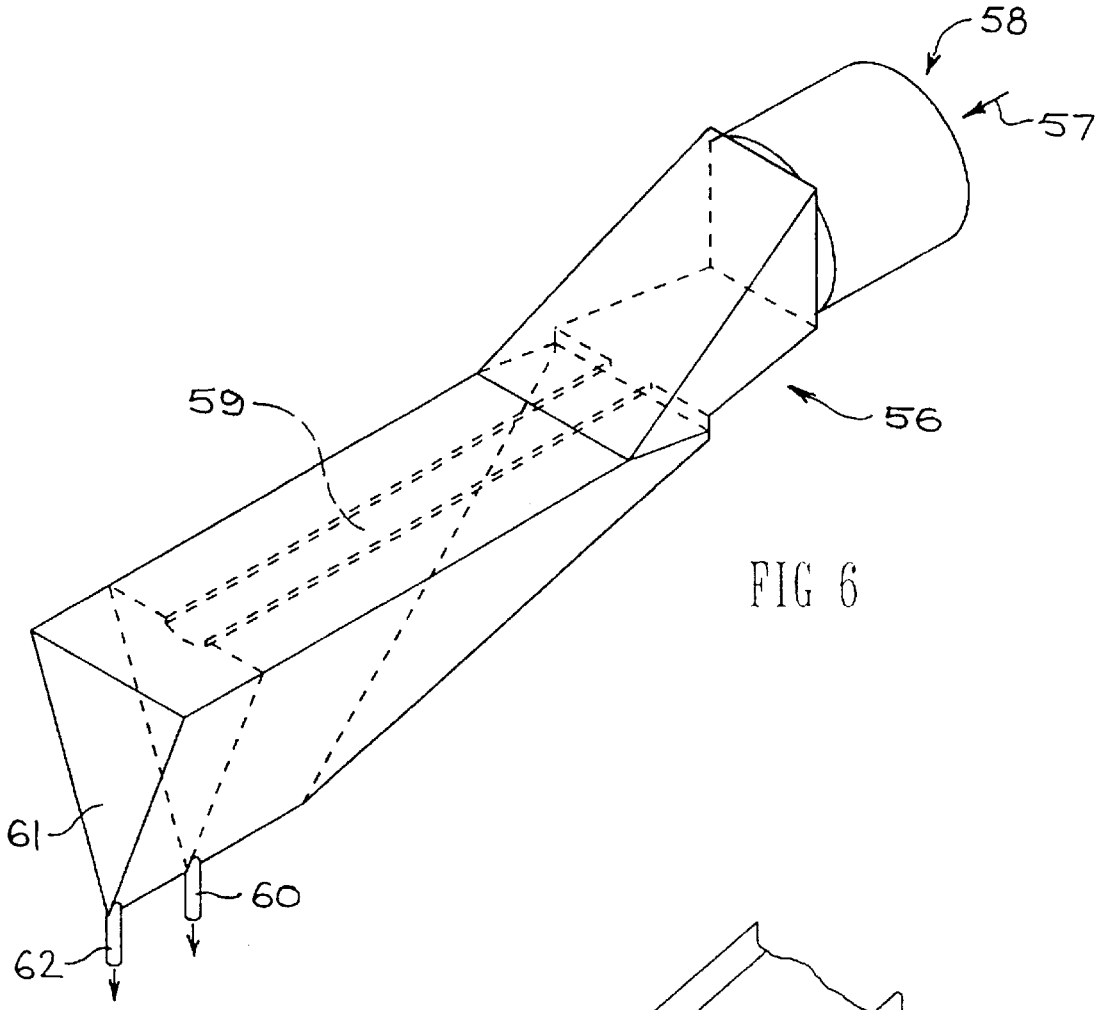
FIGS. 6 and 7 show perspective and front views respectively of one form of separator suitable for laboratory separation of weakly ferrimagnetic particles from paramagnetic particles.
Figure 7:
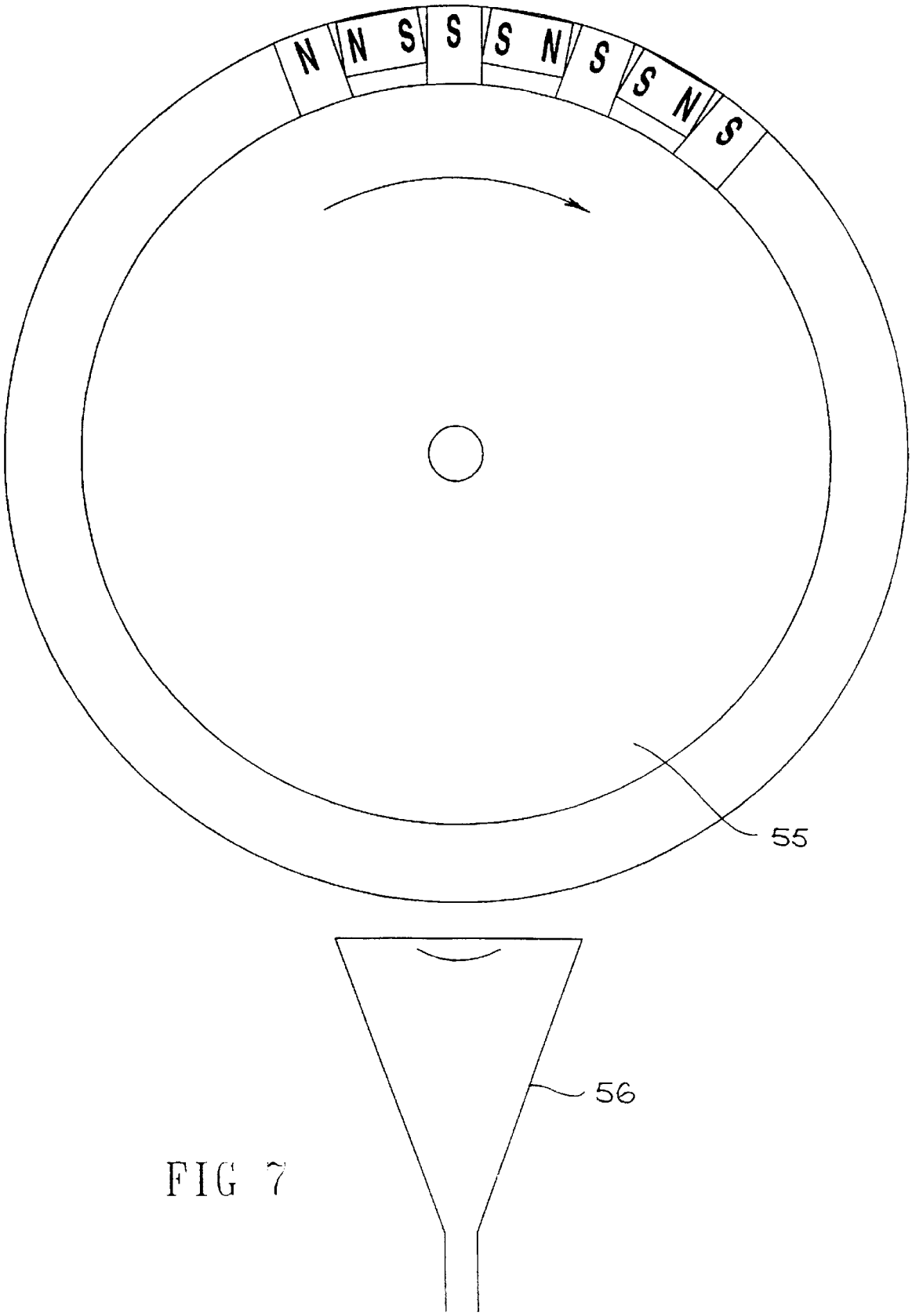

Referring to FIGS. 6 and 7, this separator utilises a rotating magnetic drum 55 similar to that shown in FIGS. 2, 4 and 5. Separation takes place within a separation cell 56 mounted underneath magnetic drum 55, so that it lies essentially parallel to the rotation axis of magnetic drum 55. The position of separation cell 56 underneath magnetic drum 55 is shown in FIG. 7. The axis of magnetic drum 55 is tilted so that particles entering the separator are able to move through the separator essentially under the influence of gravity. In some embodiments of the invention movement of particles may be assisted by imparting vibration to separation cell 56.

Particles to be separated via separation cell 56 are weakly magnetic and contain no strongly magnetic material. The particles to be separated are fed in a slurry 57 to inlet 58 of separation cell 56 as shown in FIG. 6. The particles pass down separation cell 56 along concave separation platform 59. As the particles pass down separation platform 59 they come under influence of both a magnetic field gradient and magnetic field rotation. The magnetic field gradient will attract the particles and decrease interaction of magnetic particles with separation platform 59, thereby making any particle rotation easier. Those particles which are weakly ferrimagnetic or which have sufficiently high magnetic anisotropy so that they are able to rotate with the magnetic field, roll themselves to one side and fall off separation platform 59, to exit via weak ferrimagnetic/anisotropic outlet 60. The particles separated in cell 56 will generally not be sufficiently magnetic to be fully lifted in the magnetic field gradient, but if they are magnetic enough to be lifted they will be rotated as they approach magnetic drum 55 and will roll off separation platform 59 before they are beneath magnetic drum 55 where they can be lifted. Those particles which are paramagnetic and magnetically isotropic will not be rotated and will pass down separation platform 59 into end compartment 61, and will exit via paramagnetic/isotropic outlet 62.

Magnetic particles which rotate with the field, at the high rotation frequencies used for eddy current separation, will roll themselves in the opposite direction to the direction of travel of outer drum 81, down over the front of outer drum in the direction shown via arrow D. Due to the field gradient they will be attracted to surface 83 of drum 81 and will tend to roll back under drum 81 until they reach a point far enough from magnetic drum 80 where the force of gravity detaches them from surface 83 of outer drum 81.

Figure 8:
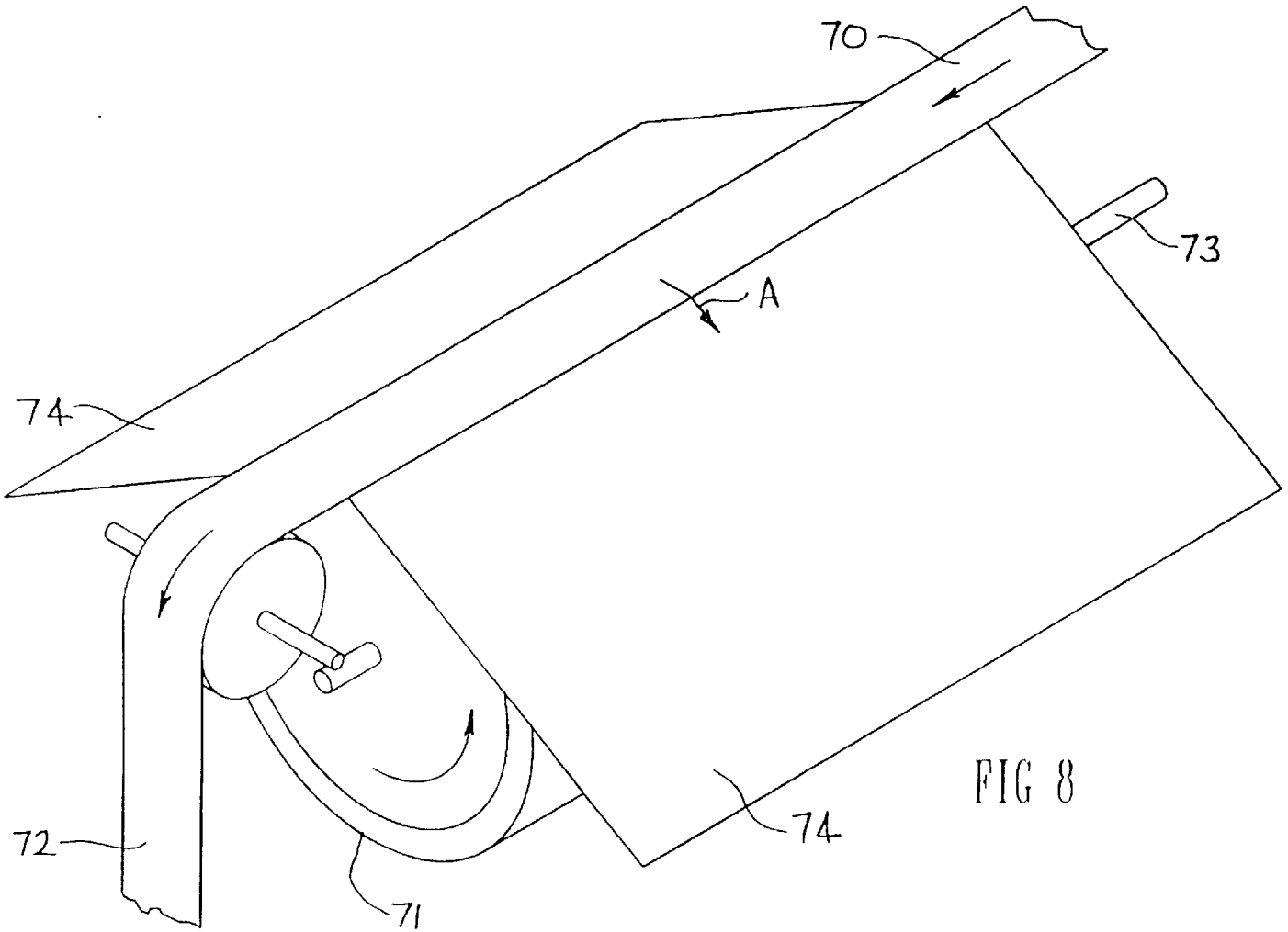
FIG. 8 shows one form of separator suitable for dry separation, by eddy current rotation, of small non-ferrous metallic particles.
Figure 10:
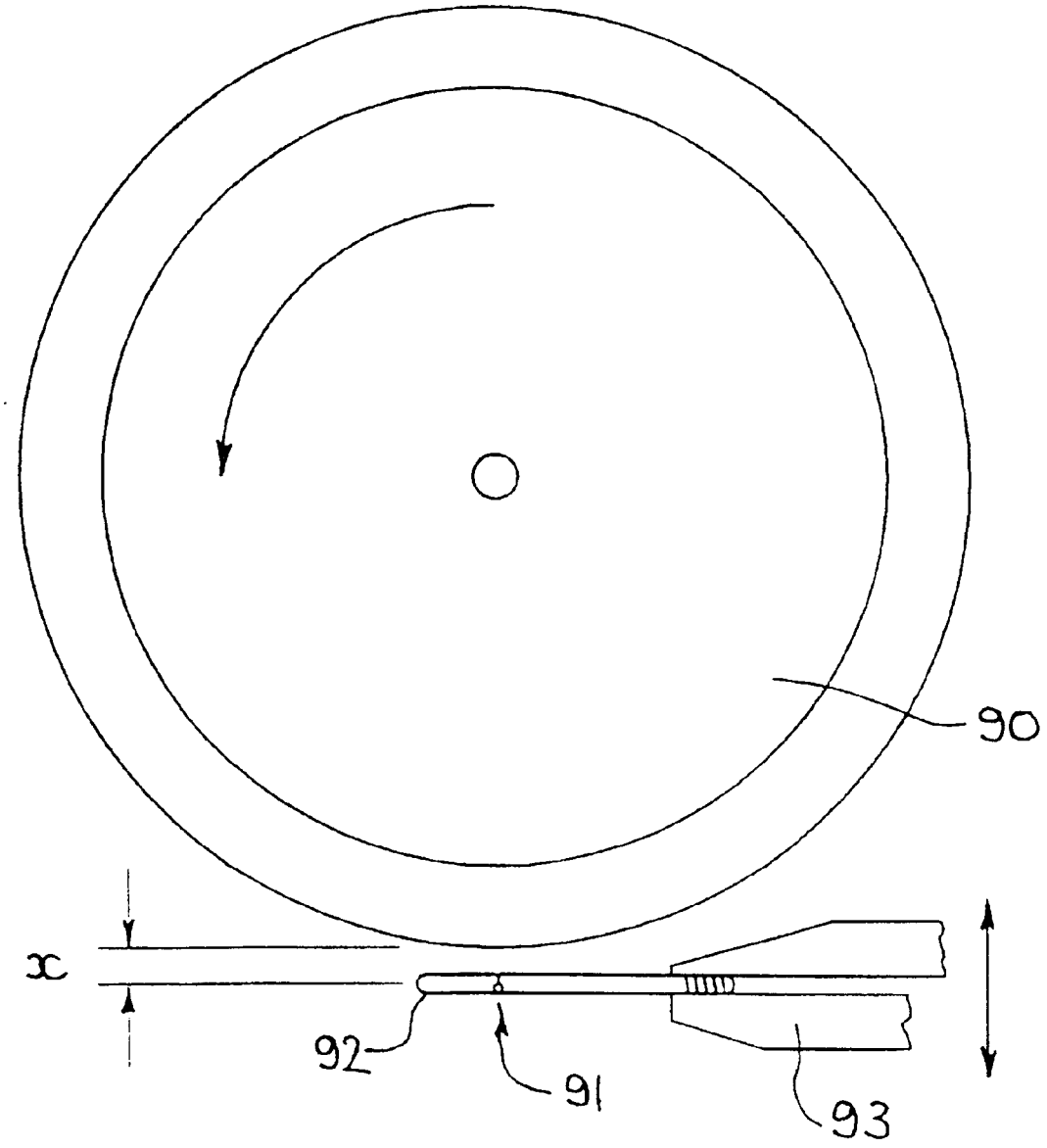
FIG. 10 shows one form of apparatus suitable for measuring magnetic susceptibility and rotation index of particles.

An arrangement similar to that illustrated in FIG. 6 may be used for investigations of rotations in small non-ferrous metallic particles. One arrangement for investigating such eddy current particle rotations is shown in FIG. 8. Here the separation is carried out dry, and particles 70 to be separated are carried above rotating magnetic drum 71 by a conveyor belt 72. The rotating magnetic drum 71 has the same basic arrangement of magnets as is shown in FIGS. 4, 5 and 7, but is arranged with its axis of rotation 73 parallel to the direction of travel of conveyor belt 72 so that metallic particles which rotate are rolled to one side as shown via arrow A where they fall from conveyor belt 72 along side skirts 74. Unlike the normal eddy current separation method, where the magnetic drum is arranged with its axis of rotation at right angles to the direction of travel of the conveyor belt, the arrangement shown in FIG. 8 is able to handle ferromagnetic particles and metallic particles down to particle sizes of less than 50 micrometers in diameter.

Figure 9:
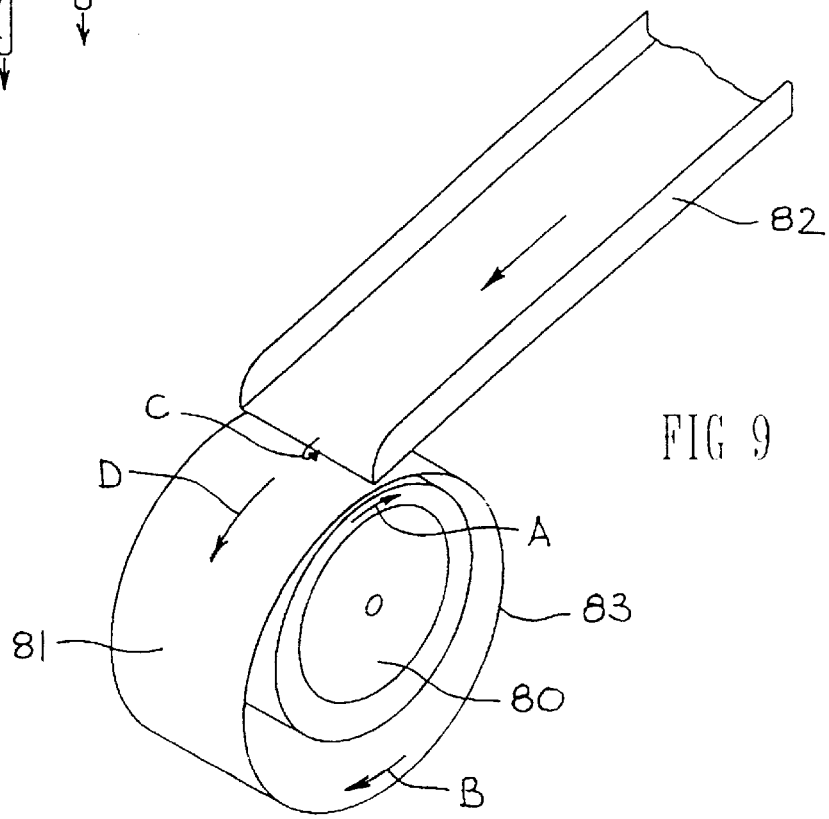
FIG. 9 shows one form of separator suitable for dry separation of both magnetic particles and non-magnetic metallic particles, at a higher through-put than for FIG. 8.

FIG. 9 shows an alternative eddy-current separator, which gives higher through-put than that of FIG. 8. The arrangement shown in FIG. 9 uses an inner rotating magnetic drum 80, similar to that shown in FIG. 7, rotating in the direction shown via arrow A, and an outer non-metallic drum 81 which rotates slowly in the opposite direction shown via arrow B. Outer drum 81 carries non-metallic particles back under feed chute 82 as shown via arrow C. Particle feed is provided via a feed chute 82 which needs to be constructed of non-metallic material (eg. plastics or fibre-glass). Outer drum 81 may be of much larger diameter than magnetic drum 80 so as to allow magnetic particles which may be present in feed material to roll themselves (or to be carried in the opposite direction) further away from magnetic drum 80 to a distance where they are far enough from drum 80 to drop off. Because of the ability of the arrangement to handle magnetic particles, such a separator could be used as a combined eddy current-magnetic separator.

Metallic particles which rotate with the field, at the high rotation frequencies used for eddy-current separation, will roll themselves in the opposite direction to the direction of travel of outer drum 81, down over the front of outer drum 81 in the direction shown via arrow D. Due to the field gradient they will be attracted to surface 83 of drum 81 and will tend to roll back under drum 81 until they reach a point far enough from magnetic drum 80 where the force of gravity detaches them from surface 83 of outer drum 81.

Magnetic particles which do not rotate are carried back under feed chute 82 along with non-magnetic and non-metallic particles. They will adhere to surface 83 of outer drum 81 due to the magnetic field gradient until they are carried far enough away from magnetic drum 80 to drop off under influence of gravity.

Non-ferrous metallic particles will rotate in the rotating magnetic field and will roll themselves, against the direction of rotation of outer drum 81, down over the front of outer drum 81. As they are not attracted in the field gradient (they may actually be repelled in the normal eddy current fashion) they will either fall straight down over the front of drum 81 or be deflected further out from the front of outer drum 81.

Non-magnetic and non-metallic particles are carried back under feed chute 82 by the rotation of outer drum 81 and drop straight down over-the rear of drum 81.

Splitters (not shown) may be provided under outer drum 81, for separated material which may be split into non-ferrous metallic particles, magnetically ordered particles (which rotate with the field), paramagnetic particles (which do not rotate with the field) and non-metallic/non-magnetic particles.

The speed of rotation of outer drum 81 needs to be set so that the smallest metallic particles being separated are able to roll faster than the speed of outer drum 81.

Finally, it is to be understood that various alterations, modifications and/or additions may be introduced into the constructions and arrangements of parts previously described without departing from the spirit or ambit of the invention. Such alterations, modifications and/or additions may also be introduced in order to change the scale of the separations from laboratory scale to commercial processing scale, without departing from the spirit or ambit of the invention.

What is claimed is:

1. A method for separating particles such as minerals from a mixture including said particles, said method comprising the steps of:

generating a rotating magnetic field;

exposing said mixture to said rotating magnetic field so that a plurality of susceptible particles may be caused to rotate;

adjusting said rotating magnetic field to cause a rotation of a subgroup of said susceptible particles; and exploiting the rotation of said subgroup of susceptible particles to separate the subgroup of particles at least from other susceptible particles included in the mixture that do not rotate.

2. A method according to claim 1, wherein an attraction of said susceptible particles is caused against an opposing force and exploiting the attraction to separate a further subgroup of particles at least from other potentially susceptible particles included in the mixture that are not attracted against said opposing force.

3. A method according to claim 1, wherein said step of exposing includes passing the mixture along a first path relative to said rotating magnetic field.

4. A method according to claim 3, wherein said first path includes a path parallel to a rotational axis of the rotating magnetic field.

5. A method according to claim 3, wherein said first path includes a path perpendicular to a rotational axis of the rotating magnetic field.

6. A method according to claim 2, wherein said step of exploiting involves a movement of said subgroup of susceptible particles along a second path other than said first path.

7. A method according to claim 6, wherein said second path includes a path parallel to a rotational axis of the rotating magnetic field.

8. A method according to claim 6, wherein said second path includes a path perpendicular to a rotational axis of the rotating magnetic field.

9. A method according to claim 6, wherein said second path includes a path in the same direction as the rotational motion of the rotating magnetic field.

10. A method according to claims 6, wherein said second path includes a path in the opposite direction to the rotational motion of the rotating magnetic field.

11. A method according to claim 6, wherein separation of said subgroup of susceptible particles is influenced by one or more of the following:

(i) a magnetic field strength of the rotating magnetic field;

(ii) a gradient of the magnetic field;

(iii) a direction of the magnetic field relative to said first path;

(iv) a direction of the magnetic field relative to said second path;

(v) a variation of total field strength as the magnetic field rotates;

(vi) a frequency of rotation of the magnetic field; and (vii) a speed of a conveyor belt or an outer non-magnetic drum forming the second path.

12. A method according to claim 1, wherein said subgroup of susceptible particles includes particles having magnetic and/or conductive properties.

13. A method according to claim 12, wherein said properties include magnetic susceptibility, degrees and types of magnetic ordering, crystalline structure and electrical conductivity.

14. A method according to claim 1, wherein a frequency of the rotating magnetic field is 10 to 500 Hz.

15. A method according to claim 14, wherein the frequency of the rotating magnetic field is less than 100 Hz.

16. A method according to claim 14, wherein the frequency of the rotating magnetic field is greater than 200 Hz.

17. A method according to claim 1, wherein said mixture includes a slurry.

18. A method according to claim 1, wherein said mixture includes a plurality of dry particles.

19. An apparatus for separating particles such as minerals from a mixture including said particles, said apparatus including:

means for generating a rotating magnetic field;

means for exposing said mixture to said rotating field such that susceptible particles may be caused to rotate;

means for adjusting said rotating magnetic field to cause a subgroup of said susceptible particles to rotate; and means for exploiting the rotation of said subgroup of susceptible particles to separate the subgroup of particles at least from other potentially susceptible particles included in the mixture that do not rotate.

20. The apparatus according to claim 19, wherein an attraction of said susceptible particles is caused against an opposing force and means for exploiting the attraction to separate a further subgroup of particles at least from other potentially susceptible particles included in said mixture that are not attracted against said opposing force.

21. The apparatus according to claim 19, wherein said means for generating includes a rotating magnetic drum.

22. The apparatus according to claim 21, wherein said drum includes a plurality of radial magnets.

23. The apparatus according to claim 22, wherein said drum includes a plurality of tangential magnets between the radial magnets.

24. The apparatus according to claim 19, wherein said means for exposing includes means for passing said mixture along a first path relative to said rotating magnetic field.

25. The apparatus according to claim 24, wherein said first path. includes a path parallel to a rotational axis of the rotating magnetic field.

26. The apparatus according to claim 24, wherein said first path includes a path perpendicular to a rotational axis of the rotating magnetic field.

27. The apparatus according to claim 24, wherein said means for exploiting includes a surface for facilitating movement of the subgroup of susceptible particles along a second path other than said first path.

28. The apparatus according to claim 27, wherein said second path includes a path parallel to a rotational axis of the rotating magnetic field.

29. The apparatus according to claim 27, wherein said second path includes a path perpendicular to a rotational axis of the rotating magnetic field.

30. The apparatus according to claim 27, wherein said second path includes a path in the same direction as the rotational motion of the rotating magnetic field.

31. The apparatus according to claim 27, wherein said second path includes a path in the opposite direction to the rotational motion of the rotating magnetic field.

32. The apparatus according to claim 19, wherein said subgroup of susceptible particles includes particles having magnetic and/or conductive properties.

33. The apparatus according to claim 32, wherein said properties include magnetic susceptibility, degrees and types of magnetic ordering, crystalline structure and electrical conductivity.

34. The apparatus according to claim 19, wherein a frequency of the rotating magnetic field is 10 to 500 Hz.

35. The apparatus according to claim 34, wherein the frequency of the rotating magnetic field is less than 100 Hz.

36. The apparatus according to claim 34, wherein the frequency of the rotating magnetic field is greater than 200 Hz.

37. The apparatus according to claim 19, wherein said mixture includes a slurry.

38. The apparatus according to claim 19, wherein said mixture includes a plurality of dry particles.

* * * * *